US007624545B2

(12) United States Patent
Turley

(10) Patent No.: US 7,624,545 B2
(45) Date of Patent: Dec. 1, 2009

(54) GROUND ANCHOR SYSTEM

(76) Inventor: Mark Turley, 5585 N. County Rd. 575 E., Crawfordsville, IN (US) 47933-7337

( * ) Notice: Subject to any disclaimer, the term of this patent is extended or adjusted under 35 U.S.C. 154(b) by 36 days.

(21) Appl. No.: 11/747,476

(22) Filed: May 11, 2007

(65) Prior Publication Data

US 2008/0276549 A1 Nov. 13, 2008

(51) Int. Cl.

| | |
|---|---|
| ***E02D 5/74*** | (2006.01) |
| ***E02D 35/00*** | (2006.01) |
| ***E04G 21/14*** | (2006.01) |
| ***E04H 12/34*** | (2006.01) |
| ***E04H 12/20*** | (2006.01) |

(52) U.S. Cl. ..... 52/162; 52/125.2; 52/146; 52/155; 52/156; 52/157

(58) Field of Classification Search ..... 52/125.2, 52/125.3, 146, 148, 155, 156, 157, 158, 159, 52/160, 161, 162, 163, 164, 165, 166, 169.13
See application file for complete search history.

(56) References Cited

U.S. PATENT DOCUMENTS

| | | | | | |
|---|---|---|---|---|---|
| 215,490 | A | | 5/1879 | Swenson | |
| 772,515 | A | * | 10/1904 | Jackman | 52/162 |
| 1,817,247 | A | | 8/1931 | Gebhard | |
| 2,404,151 | A | * | 7/1946 | Washam | 52/164 |
| 2,870,884 | A | * | 1/1959 | Mazur | 52/158 |
| 3,500,598 | A | | 3/1970 | Ettinger | |
| 3,601,941 | A | * | 8/1971 | Watanabe et al. | 52/162 |
| 3,655,160 | A | | 4/1972 | Grillot | |
| 3,732,841 | A | * | 5/1973 | Mayo | 114/295 |
| 3,774,361 | A | * | 11/1973 | Tanner | 52/162 |
| 3,848,367 | A | * | 11/1974 | Barnes | 52/157 |
| 4,026,080 | A | | 5/1977 | Meikle | |
| 4,258,514 | A | * | 3/1981 | St. Clair | 52/86 |
| 4,380,139 | A | * | 4/1983 | Mitchell | 52/162 |
| 4,825,604 | A | | 5/1989 | Manning | |
| 6,591,564 | B2 | * | 7/2003 | Cusimano | 52/274 |
| 6,955,243 | B1 | * | 10/2005 | Huff | 182/107 |
| 7,047,696 | B2 | * | 5/2006 | DiDomenico | 52/166 |
| 2002/0088187 | A1 | * | 7/2002 | Howard et al. | 52/162 |

FOREIGN PATENT DOCUMENTS

| | | |
|---|---|---|
| DE | 1817247 | 7/1969 |

* cited by examiner

*Primary Examiner*—Richard E Chilcot, Jr.
*Assistant Examiner*—Branon C Painter
(74) *Attorney, Agent, or Firm*—Homer W. Faucett, III; Ice Miller LLP

(57) ABSTRACT

A portable ground anchor system comprises base plate members having a hinge pin passage formed therethrough and each base plate member having a multiplicity of holes formed therethrough for interaction with ground spikes; central triangular shaped plate members having circular openings formed therethrough at a triangular apex thereof; a spacer member adapted to provide an engagement for a cable, said spacer member interconnected between said central triangular shaped plate members; a cylindrical pin for pivotally joining the base plate members and the central triangular members.

6 Claims, 5 Drawing Sheets

GROUND ANCHOR SYSTEM

FIELD OF THE INVENTION

This invention relates to anchors. In particular, this invention relates to portable ground anchors for use in extracting vehicles from a trapped position by means of a winch.

BACKGROUND OF THE INVENTION

Vehicles which travel off road, on unpaved surfaces or on weather covered streets are often subject to traps which prevent desired travel in the vehicles, These vehicles may encounter mud, snow, sand or other traps in which vehicle tires are deprived of significant friction against a solid surface. Without sufficient friction against a solid surface, vehicle tires are unable to provide adequate traction to propel the vehicle in motion and free it from the mire. A winch is a useful tool for freeing trapped vehicles from earthen traps. In order to free a trapped vehicle, a winch is situated between a nearby stationary object and the vehicle to be removed from the trap. One end of the winch is connected by cable, rope, chain or other line device to the nearby stationary object. The other end of the winch is either attached to the vehicle or connected to the vehicle by cable, rope, chain or other line device. Pulley action within the winch shortens the total length of line between the vehicle and the stationary object, and assists the trapped vehicle in freeing itself from the trap.

A problem may arise for vehicles that become trapped in an area void of stationary objects such as trees, fenceposts, buildings, or other fixed structures. Without a stationary object, the line and winch has nothing to pull against, and the vehicle will remain trapped in the mire.

Ground anchors are useful in freeing vehicles from the confines of snow, mud, sand or other traps when there are no stationary objects in the near vicinity to the trapped vehicles. Ground anchors provide the necessary ground gripping action to pull a vehicle from mire when there are no stationary objects in the nearby vicinity.

Ground anchors of various types have been previously described as exemplified in U.S. Pat. Nos. 4,825,604 to Manning, 4,026,080 to Meikle and 3,500,589 to Ettinger. However, previous ground anchors have provided insufficient ground gripping when heavyduty vehicles must be removed from deep mire. Larger ground anchors are helpful in providing additional strength, but may be inconveniently bulky to haul and use. Additionally, many ground anchors are difficult to use or require substantial efforts to remove from the ground.

Therefore, it is an object of the invention to provide a portable ground anchor of sufficient strength that heavy-duty loads may be applied to the anchor. Another object of the invention is to provide a portable ground anchor that is collapsible so that it may be easily hauled in a vehicle. It is a further object of the invention to provide a portable ground anchor that may be easily assembled, is convenient and simple to use, and requires little effort to remove from the ground and disassemble after use.

SUMMARY OF THE INVENTION

The present invention relates to an improved ground anchor system for anchoring one end of a cable to the ground. The improved ground anchor system comprises a pair of hingedly attached, ground engaging base plates supporting a pair of vertically extending, pivoting central plates which are horizontally joined by one or more cable attachment bars. The base plates may be removably affixed to uneven or sloping ground by several long spikes or rods to provide a firm, but temporary and reusable anchor for a vehicle's winch cable.

The ground anchor system is easily collapsed and stored in a vehicle so that it may be used upon demand. Furthermore, the ground anchor system is quickly and easily assembled for use and, upon assembly, provides sufficient strength that heavy loads may be supported by the anchor.

DETAILED DESCRIPTION OF THE INVENTION

Figure 1:
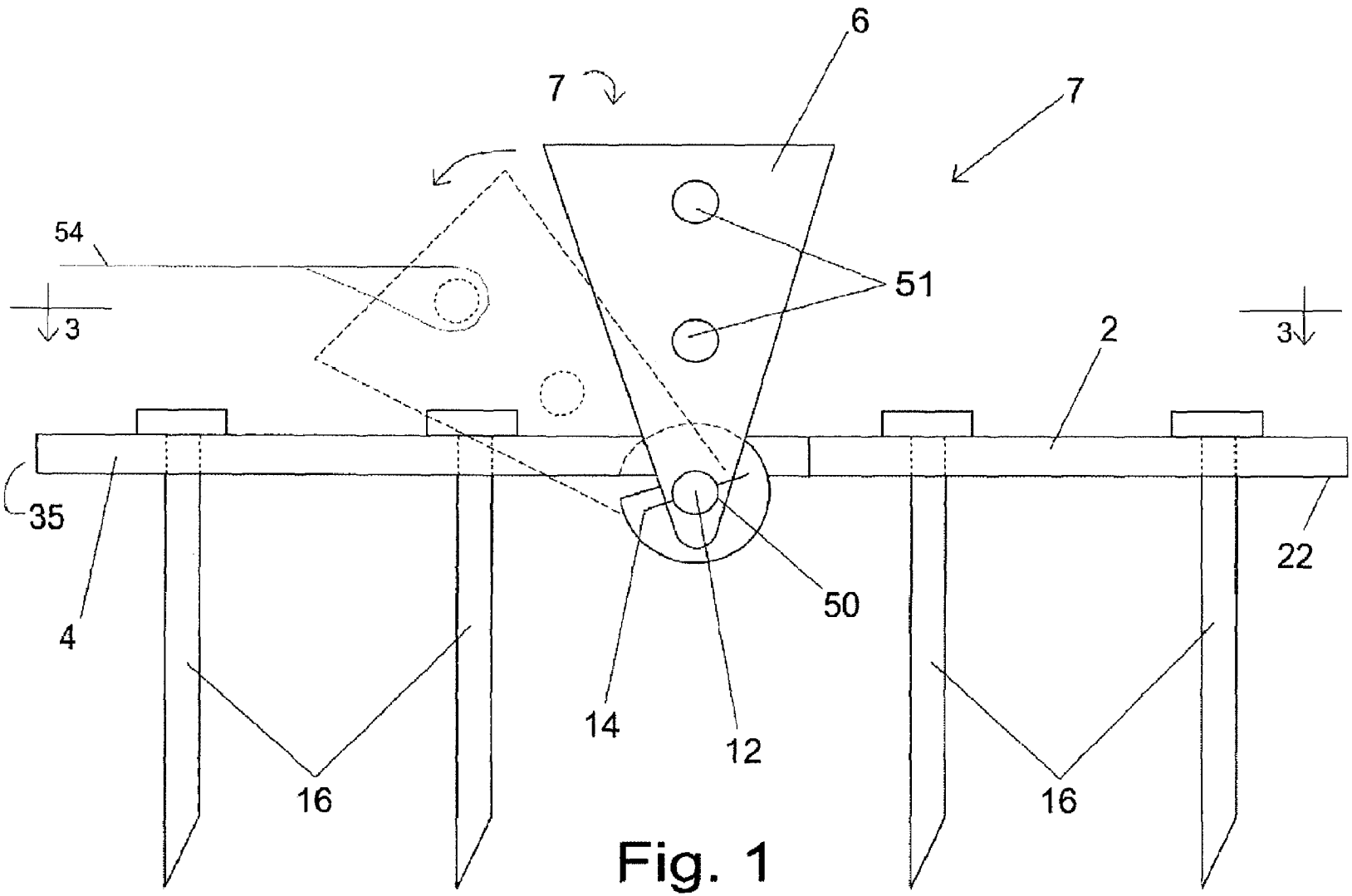
FIG. 1 is a side plan view of one embodiment of an improved ground anchor system in accordance with the present invention.
Figure 2:
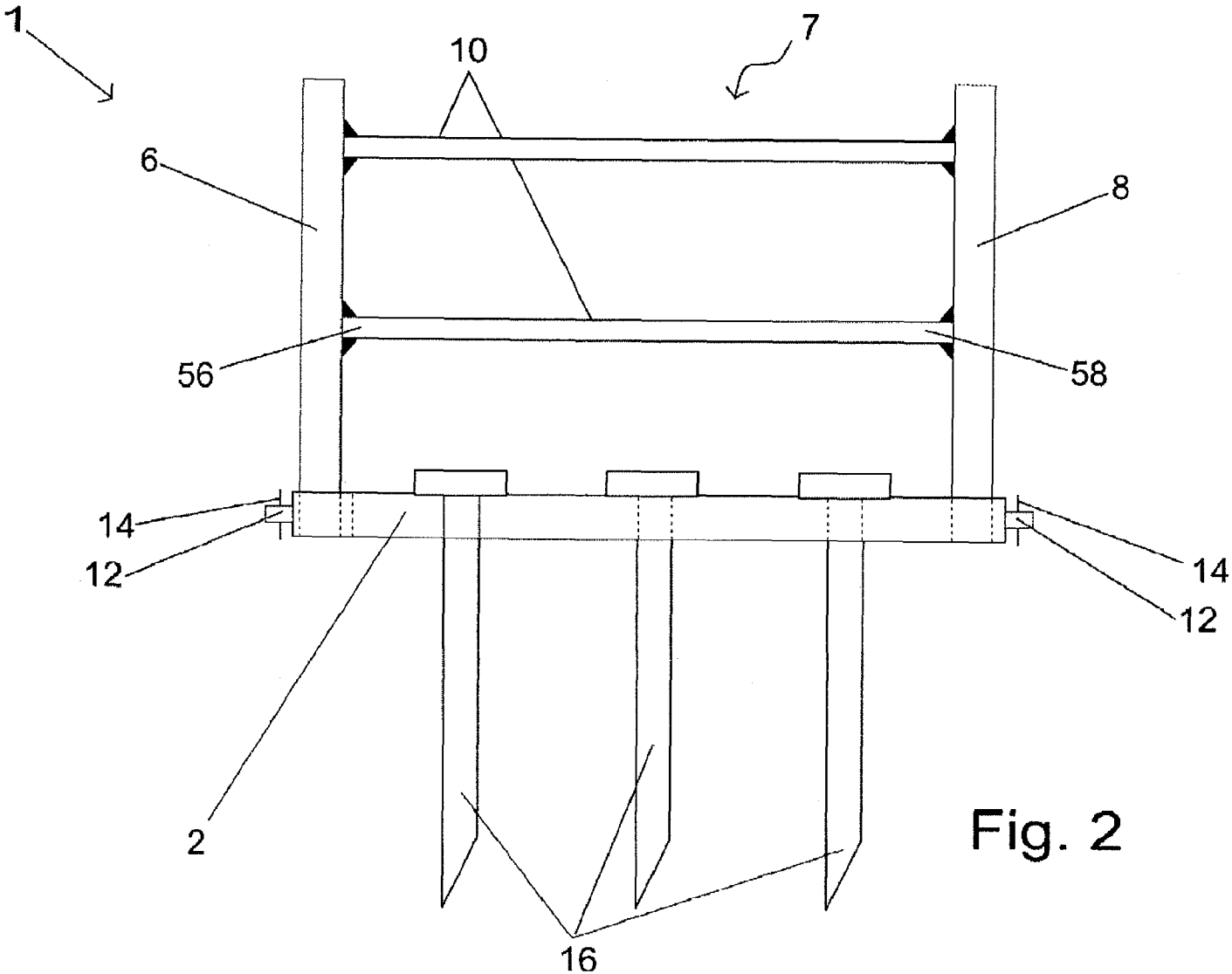
FIG. 2 is a side plan view of the improved ground anchor system illustrated in FIG. 1, rotated about 90° from the viewing angle of FIG. 1.
Figure 3:
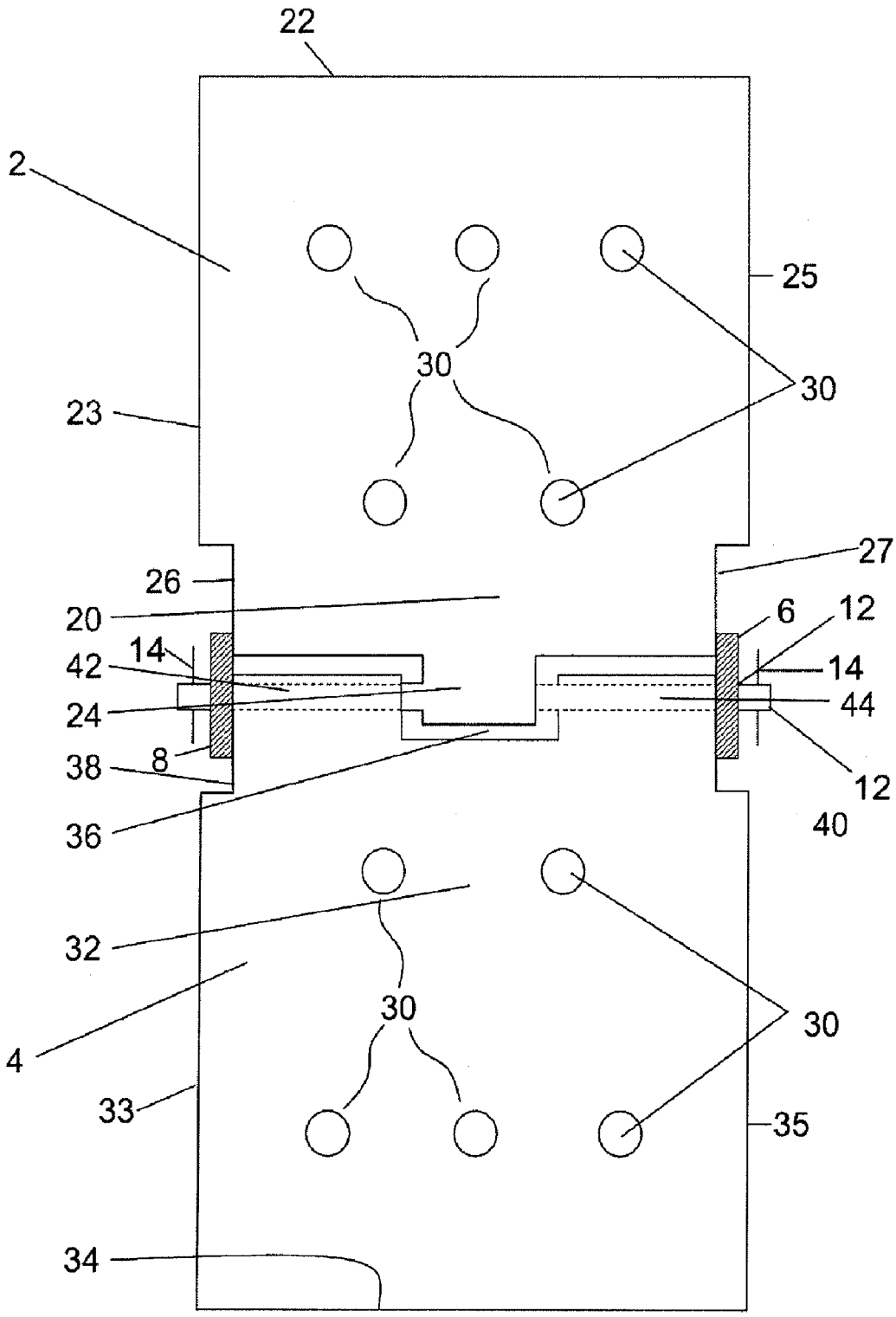
FIG. 3 is a top plan view of a first and a second base member of the improved ground anchor system taken substantially along line 3-3 in FIG. 1.

Referring to FIG. 1, 2 and FIG. 3, an improved ground anchor system 1 comprises a first base member 2, a second base member 4, a first central member 6, a second central member 8, spacers 10, a hinge pin 12, retainer clips 14, and ground spikes 16.

The first base member 2 comprises a steel plate being about 10 inches wide, about 12 inches in length, and about 1 inch in thickness. Referring to FIG. 3, the first base member 2 includes a front portion 20, a rear edge 22, side edges 23 and 25, first indented portion 26 adjacent side edge 23 of member 2, second indented portion 28 adjacent side edge 25 of member 2. A hinge member 24 extends outwardly from front portion 20, and spike holes 30 extend at various locations through base member 2.

The second base member 4 also comprises a steel plate about 10 inches wide, about 12 inches in length, and about 1 inch in thickness. The second base member 4 comprises a front portion 32, a rear edge 34, side edges 33 and 35, a first indented portion 38 adjacent side edge 33, and a second indented portion 40 adjacent side edge 35. A first hinge 42 and a second hinge 44 are formed on and extend outwardly from front portion 32. A female slot 36 is formed between first and second hinges 32 and 34 to receive hinge member 24. Spike holes 30 extend at various locations through base member 4.

Figure 6B:
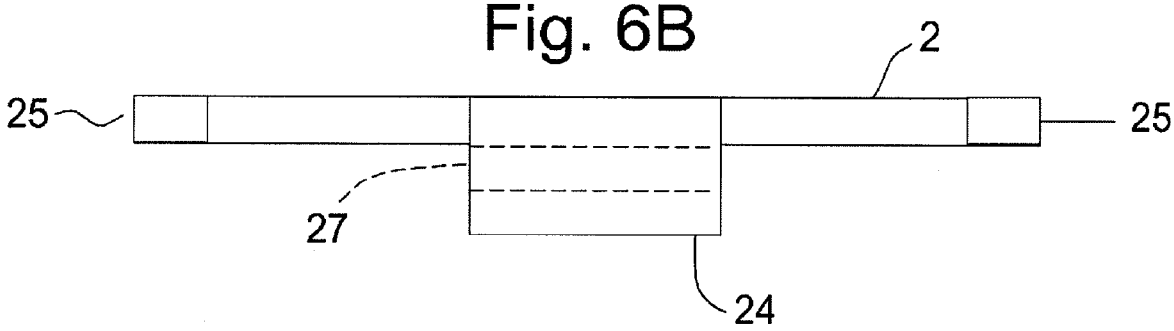
FIG. 6B is an end view of the first base member taken substantially alone line 6B-6B in FIG. 6A.
Figure 6A:
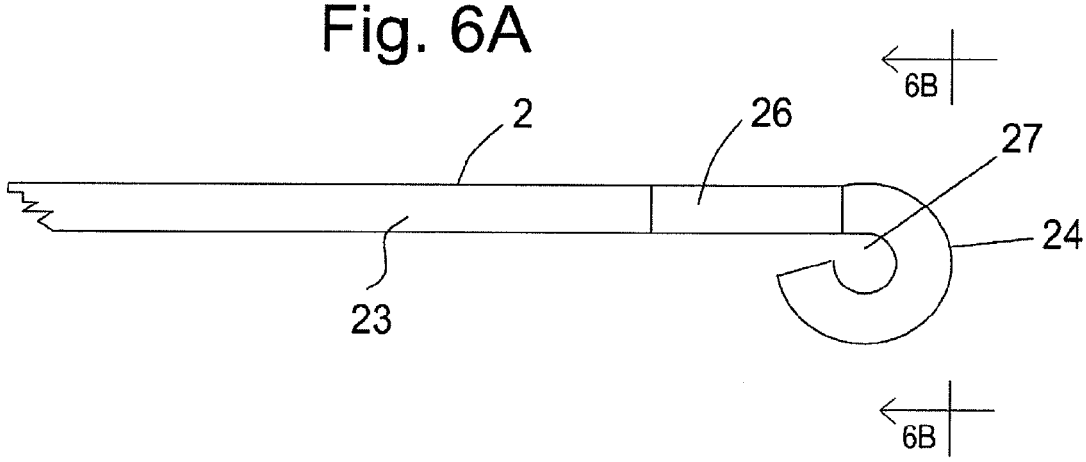
FIG. 6A is a side partial plan view of the first base member of the improved ground anchor system illustrated in FIG. 1.

With reference to FIGS. 6A and 6B, hinge member 24 is formed by bending an extending portion of front portion 20 into a circle to form a circular channel 27 dimensioned to freely receive hinge pin 12. Hinge members 42 and 44 are similarly formed by bending extending portions of front portion 32 into a circle to form a circular channel dimensioned to freely receive hinge pin 12. The hinge member 24 is placed into female slot 36 so that the circular channel 27 of hinge member 24 aligns with the circular channels in hinge members 42 and 44, and thus hinge pin 12 can be inserted through the channels so that first base member 2 and second base member 4 become pivotally connected.

Ground spikes 16 are typically formed from cylindrical steel and are about 24 inches in length. The diameter of spikes 16 is slightly less that the diameter of spike holes 30 so that the spikes 16 can be inserted into holes 30 and pounded into the ground to secure the first base member 2 and the second base member 4 in a fixed position upon the ground.

Figure 5:
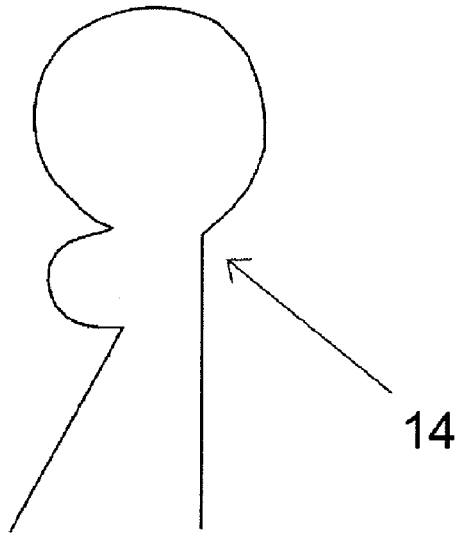
FIG. 5 is a plan view of a retention pin of the improved ground anchor system.

The hinge pin 12 comprises a steel shaft of about 12 inches in length and about ¾ inches in diameter. The hinge pin 12 further comprises small circular openings (not shown) drilled through hinge pin 12 at opposing ends and dimensioned to receive retainer clips 14. The retainer clips 14 (FIG. 5) may be inserted into the small circular openings in hinge pin 12 to prevent the hinge pin 12 from moving out of the circular channels in hinge members 24, 42, and 44.

Figure 4:
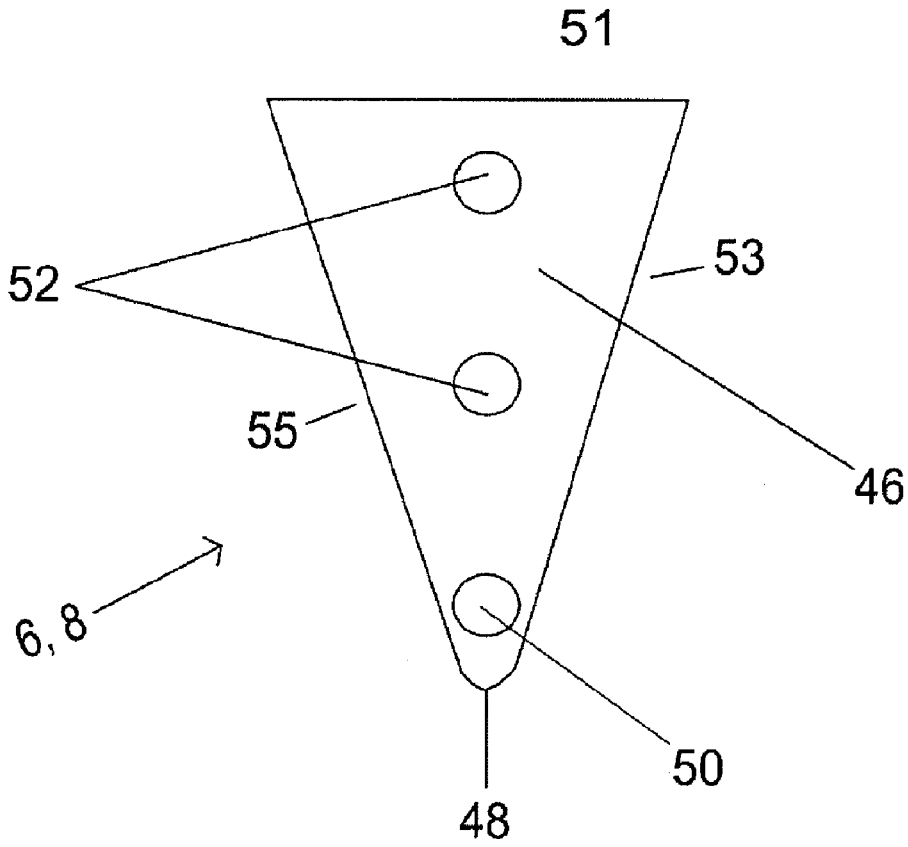
FIG. 4 is a side plan view of a central member of the improved ground anchor system illustrated in FIG. 1.

Referring to FIGS. 1, 2 and 4, central assembly 7 is pivotally joined to the assembly by hinge pin 12 extending through openings 50 at apexes 48 of central members 6 and 8. The first central member 6 and second central member 8 each comprise a triangular shaped plate of steel 46 (see FIG. 4), each having a width of about 5 inches at a base 51, a height of about 8⅜ inches along edges 53 and 55, and a thickness of about 1 inch. The first central member 6 and second central member 8 each further comprise a triangular apex 48, a circular opening 50, and spacer attachment openings 52. The circular openings 50 of the first central member 6 and the second central member 8 are dimensioned slightly larger than hinge pin 12 so that hinge pin 12 can be freely inserted therethrough. Central assembly 7 is formed by placing the ends of spacers 10 into attachment openings 52 and retaining them by welding or other suitable means of attachment so that central members 6 and 8 are retained in a spaced apart relationship such that the apexes 48 will extend into indented portions 26, 28, 38 and 40 of base members 2 and 4. Spacers 10 could also be threaded at each end and attached by using nuts on each side of members 6 and 8 to facilitate disassembly. The spacers 10 also provide a means to attach a winch cable 54 to the improved ground anchor 1. Additionally, the spacers 10 permit the central assembly 7 to pivot around hinge pin 12, and also add structural strength to the assembly.

To assemble the combination, the first base member 2 and the second base member 4 are positioned so that the hinge member 24 is between hinges 42 and 44 in slot 36 so that the circular channels align. Central assembly 7 is positioned so that the openings 50 also align with the circular channels in the hinge members. Hinge pin 12 is inserted through openings 50 and the circular channels 27 and retainer clips 14 are placed through the openings in the hinge pin 12 to lock the hinge pin in place. The ground spikes 16 can be inserted into the spike holes 30 in first base member 2 and second base member 4 to position the spikes 16 to be driven into the ground.

Operation of the improved ground anchor system 1 is now described. Once the assembly has been completed, the improved ground anchor system 1 is place at the desired ground location. Preferably, the base members should be oriented such that the hinge pin 12 is parallel to the bumper of the trapped vehicle and perpendicular to the force vector to be applied by the cable. Ground spikes 16 are pounded into the ground though the spike holes 30 to secure the first base member 2 and the second base member 4 to a fixed position against the earth.

After anchoring the invention to the earth, the improved ground anchor system 1 may be used to free trapped vehicles from earthen mire, With the hinge pin 12 oriented approximately perpendicular to the cable 54 to be attached to the trapped vehicle, the central assembly 7 can be pivoted toward the trapped vehicle as shown by the dotted lines in FIG. 1. A winch (not shown) and cable 54 is used to link the trapped vehicle (not shown) to one or more of the spacers 10 of the improved ground anchor system. One end of a winch cable 54 is connected to the present invention 1 at a spacer 10, and the other end of the winch and cable system is connected to the trapped vehicle. After the central assembly 7 is pivoted toward the trapped vehicle, the winch is operated to remove slack in the winch cable 54 and pull the cable taut. As the vehicle attempts to drive out of the mire, additional slack in the winch cable 54 is removed by operation of the winch until the vehicle is freed. By use of a winch and cable, the improved ground anchor system 1 is capable of assisting trapped vehicles and freeing them from mire.

As may be seen, as force is applied to cable 54, central assembly 7 pivots toward the mired vehicle thus bringing the line of force being applied along cable 54 closer to the plane of base members 2 and 4. This increases the effectiveness of the anchor because the force applied is closer to the base members 2 and 4 making the force on the ground spikes 16 more in shear because the moment arm of the system is substantially reduced. Further, because base members 2 and 4 are pivotally connected at hinge pin 12, the point at which the pulling force is applied to the assembly, any upward force on the pin 12 created by the moment arm of central assembly 7 tends to cause a downward force at the edge 22 of first base member 2 and edge 35 of second base member 4 thereby tending to cause the spikes 16 in first base member 2 to squeeze toward the spikes 16 in second base member 4 thereby tending to hold the spikes 16 more firmly in the ground. Thus, the present anchor is far more effective than if a single unitary base member were used.

It will be appreciated by those skilled in the art that the present invention is capable of easy assembly and disassembly, and that upon disassembly, it may be conveniently carried in any vehicle.

It will be further appreciated by those skilled in the art that the present invention may be fixed to the ground for other purposes such as to secure an airplane against the wind or a boat to the shore. Further the anchor of the present invention is useful for any purpose requiring a strong stationary ground anchor.

What is claimed is:

1. A portable ground anchor system for anchoring one end of a cable to the ground, said system comprising:

a first base member;

a second base member;

a first central member;

a second central member;

spacer means for providing an engagement for a cable, said spacer means interconnected between said first and second central members so that said first and second central members are retained in a spaced apart relationship;

means for pivotally joining the first base member and the second base member along opposing coincident edges of said first and second base members, said means for joining also pivotally connecting said first and second central members to said first and second base members;

means for anchoring said first and second base members to the ground and wherein said first and second base members have holes formed therein and said means for anchoring comprises metal spikes that can be driven through said holes and into the ground when said first and second base members are placed on the ground to anchor said first and second base members to the ground.

2. A portable ground anchor system as claimed in claim 1, wherein said spacer means comprises a cylindrical member having first and second ends, and further comprising first connecting means for connecting the first end of said cylindrical member to said first central member and second connecting means for connecting said second end of said cylindrical member to the second central member.

3. A portable ground anchor system for anchoring one end of a cable to the ground, said system comprising:

a first base member;

a second base member;

a first central member;

a second central member;

spacer means for providing an engagement for a cable, said spacer means interconnected between said first and second central members so that said first and second central members are retained in a spaced apart relationship;

means for pivotally joining the first base member and the second base member along opposing coincident edges of said first and second base members, said means for joining also pivotally connecting said first and second central members to said first and second base members;

means for anchoring said first and second base members to the ground and wherein said first base member has a male hinge means formed along an edge thereof, and said second base member has a female hinge means formed along an edge thereof, said male and female hinge means each having a channel formed therethrough, said channel in said male and female hinge means being aligned when the male and female hinge means are joined, and said means for joining comprises a cylindrical hinge pin that extends through said channels in said male and female hinge means to pivotally join said male and female hinge means together.

4. A portable ground anchor system as claimed in claim 3, wherein said first central member and said second central member are each triangular in shape with a circular opening formed through a triangular apex of each of said first and said second central members and said first and second central members are retained by said spacer means so that said circular openings through said apex of each of said first and said second central members are aligned to allow said hinge pin to extend through said circular openings to pivotally joining the first and second central members to said first and second base members.

5. A portable ground anchor system as claimed in claim 4, wherein said hinge pin is removable to allow said anchor system to be disassembled for easy storage.

6. A portable ground anchor system for anchoring one end of a cable to the ground, said system comprising:

a first base plate member having a multiplicity of holes formed therethrough and having a male hinge means formed along an edge thereof, said male hinge means having a hinge pin opening formed therethrough;

a second base plate member having a multiplicity of holes formed therethrough and having a female hinge means formed along an edge thereof, said female hinge means having a hinge pin opening formed therethrough;

a first central triangular shaped plate member having a circular opening formed therethrough at a triangular apex thereof;

a second central triangular shaped plate member having a circular opening formed therethrough at a triangular apex thereof;

a spacer member adapted to provide an engagement for a cable, said spacer member interconnected between said first and second central triangular shaped plate members so that said first and second central plate members are retained in a spaced apart relationship and the circular openings are aligned opposite one another;

a cylindrical pin for pivotally joining the first base plate member and said base second plate member together and also pivotally connecting said first and second central plate members to said first and second base plate members when said male and female hinge members are positioned so that said hinge pin openings in each are aligned and when said circular openings in said central plate members are aligned with the pin openings in said male and female hinge members, and said pin is inserted through said aligned pin openings and circular openings; and anchor spikes adapted to be inserted through the openings in said first and said second plate member and to be driven into the ground.

* * * * *